US005197856A

United States Patent [19]

Koertge et al.

[11] Patent Number: 5,197,856

[45] Date of Patent: Mar. 30, 1993

[54] COMPRESSOR STATOR

[75] Inventors: Thomas S. Koertge, Norwood, Ohio; Mohammad Ehteshami, Fontainebleau, France; Ambrose A. Hauser, Wyoming; James W. Tucker, Cincinnati, both of Ohio

[73] Assignee: General Electric Company, Cincinnati, Ohio

[21] Appl. No.: 719,424

[22] Filed: Jun. 24, 1991

[51] Int. Cl.[5] ..... F04D 29/60

[52] U.S. Cl. ..... 415/209.3; 415/199.4; 415/209.2

[58] Field of Search ..... 415/199.1, 209.2, 209.3, 415/209.4, 190, 191, 189

[56] References Cited

U.S. PATENT DOCUMENTS

| | | | |
|---|---|---|---|
| 2,724,546 | 11/1955 | Barrett, Jr. et al. . | |
| 2,915,281 | 12/1959 | Ridley et al. | 415/209.2 |
| 2,917,276 | 12/1959 | Klompas et al. . | |
| 2,974,928 | 3/1961 | Ridley | 415/209.2 |
| 3,024,968 | 3/1962 | Payne et al. . | |
| 3,728,041 | 4/1973 | Bertelson | 415/209.2 |
| 4,426,191 | 1/1984 | Brodell et al. | 415/189 |
| 4,687,413 | 8/1987 | Prario | 415/190 |
| 4,889,470 | 12/1989 | Scalzo | 415/209.2 |

FOREIGN PATENT DOCUMENTS

| | | | |
|---|---|---|---|
| 0017534 | 10/1980 | European Pat. Off. | 415/139 |

*Primary Examiner*—Edward K. Look
*Assistant Examiner*—Michael S. Lee
*Attorney, Agent, or Firm*—Jerome C. Squillaro

[57] ABSTRACT

A compressor stator includes an axial centerline axis and has a unitary annular outer case and a plurality of circumferentially spaced outer hooks extending radially inwardly therefrom. A circumferentially segmented inner case is disposed radially inwardly within the outer case and includes a plurality of arcuate inner case segments, each including an arcuate shroud and at least one inner hook extending radially outwardly therefrom, with respective ones of the outer and inner hooks being axially slidably joined to each other for radially supporting an inner surface of the shroud at a common radius.

15 Claims, 7 Drawing Sheets

COMPRESSOR STATOR

TECHNICAL FIELD

The present invention relates generally to gas turbine engine fans and compressors, and, more specifically, to a double walled compressor stator having improved clearance control.

BACKGROUND ART

A conventional axial compressor in a gas turbine engine includes a rotor having a plurality of axially spaced rows of circumferentially spaced rotor blades with axially spaced rows of circumferentially spaced stator vanes disposed upstream of respective ones of the blade rows. The stator vanes are conventionally mounted to a single annular outer casing and extend radially inwardly therefrom.

The compressor outer casing typically includes two 180° half casings each having a pair of axial flanges extending longitudinally parallel to the centerline axis of the compressor. This allows for assembly of the compressor with the two half casings, and attached stator vanes, being positioned over and between the respective blade rows, with the axial flanges then being bolted together for completing assembly.

However, since the outer casing is an axially split member having relatively rigid axial flanges, during operation of the compressor as air is compressed through the various stages thereof, the resulting heat generated therefrom causes circumferential variations in thermal expansion of the compressor components. Since the compressor casing supports both the stator vanes and conventional shrouds surrounding the blade tips, the clearances between the shrouds and blade tips and between the stator vanes and conventional labyrinth seal teeth vary circumferentially and thus adversely affect aerodynamic performance.

The prior art includes double walled compressor casings having a unitary outer case and a circumferentially segmented inner case for providing more uniform circumferential thermal expansion and contraction. However, the use of a unitary outer casing requires special procedures for assembling the compressor which add to the complexity and cost of manufacturing the compressor. Furthermore, the prior art double walled compressor casings utilize various structures, and thusly, have varying effectiveness for reducing circumferential thermal distortion of the casings.

OBJECTS OF THE INVENTION

Accordingly, one object of the present invention is to provide a new and improved double walled compressor stator.

Another object of the present invention is to provide a compressor stator having a unitary outer case and a circumferentially segmented inner case for providing more uniform circumferential thermal expansion and contraction with reduced circumferential thermal distortion of the compressor components.

Another object of the present invention is to provide a double walled compressor stator which may be readily and accurately assembled.

DISCLOSURE OF INVENTION

A compressor stator includes an axial centerline axis and has a unitary annular outer case and a plurality of circumferentially spaced outer hooks extending radially inwardly therefrom. A circumferentially segmented inner case is disposed radially inwardly within the outer case and includes a plurality of arcuate inner case segments, each including an arcuate shroud and at least one inner hook extending radially outwardly therefrom, with respective ones of the outer and inner hooks being axially slidably joined to each other for radially supporting an inner surface of the shroud at a common radius.

BRIEF DESCRIPTION OF THE DRAWINGS

The novel features believed characteristic of the invention are set forth and differentiated in the claims. The invention, in accordance with preferred and exemplary embodiments, together with further objects and advantages thereof, is more particularly described in the following detailed description taken in conjunction with the accompanying drawing in which:

FIG. 11 is a transverse end view of a portion of adjacent inner cases of the compressor stator illustrated in FIG. 10 taken along line 12—12.

MODE(S) FOR CARRYING OUT THE INVENTION

Figure 1:
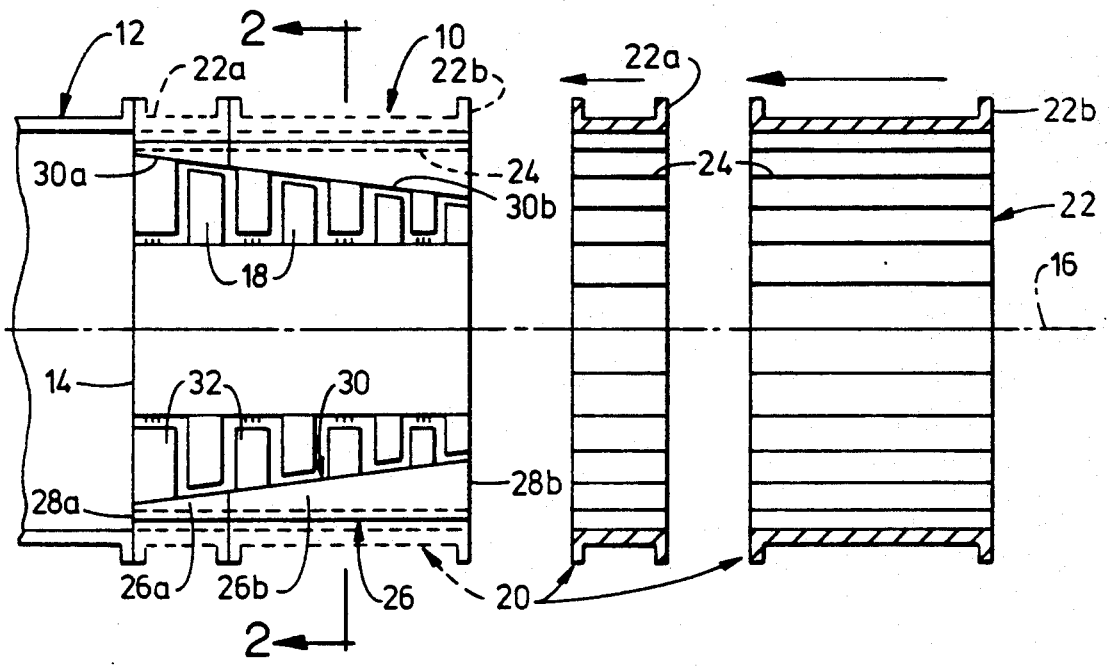
FIG. 1 is a longitudinal centerline schematic representation of an exemplary gas turbine engine compressor illustrating the outer cases thereof being positioned just prior to assembly.

Illustrated in FIG. 1 is a schematic representation of an exemplary axial compressor 10 of a gas turbine engine 12. The compressor 10 includes a conventional rotor 14 disposed coaxially about a longitudinal axial centerline axis 16. The rotor 14 includes a plurality of axially spaced rows of circumferentially spaced conventional rotor blades 18, four exemplary rows being illustrated, which extend radially outwardly from the rotor 14.

In accordance with one embodiment of the present invention, the compressor 10 includes a compressor stator 20 disposed coaxially about the centerline axis 16. The compressor stator 20 includes a unitary, 360° continuous annular radially outer case 22 disposed coaxially with the centerline axis 16. In the exemplary embodiment illustrated, the outer case 22 is in the form of a forward outer case 22*a* and an aft outer case 22*b*. Each of the outer cases 22 includes a plurality of circumferentially spaced axial outer hooks 24 extending radially inwardly therefrom and axially parallel to the centerline axis 16.

Figure 2:
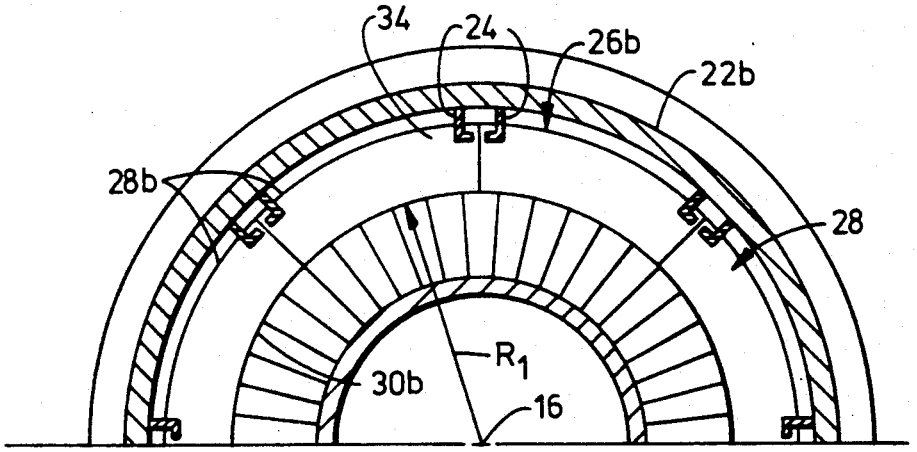
FIG. 2 is a transverse, partly sectional view of the compressor illustrated in FIG. 1 taken along line 2—2.

Referring also to FIG. 2, the compressor stator 20 further includes a circumferentially segmented radially inner case 26 which, in the exemplary embodiment illustrated, has a forward inner case 26*a* and an aft inner case 26*b*. The inner case 26 is disposed coaxially with the centerline axis 16 and includes an annular array of a plurality of circumferentially abutting, arcuate radially inner case segments 28 e.g. forward inner case segments 28*a* and aft inner case segments 28*b*. Each of the inner case segments 28 includes an arcuate shroud 30, e.g. forward shroud 30*a* and aft shroud 30*b*, from which extend radially inwardly respective pluralities of circumferentially spaced conventional compressor stator vanes 32, disposed conventionally between respective ones of the blades 18. The outer hooks 24 cooperate with a plurality of respective inner hooks 34 formed in the inner case segments 28 for the radial support thereof.

Figure 3:
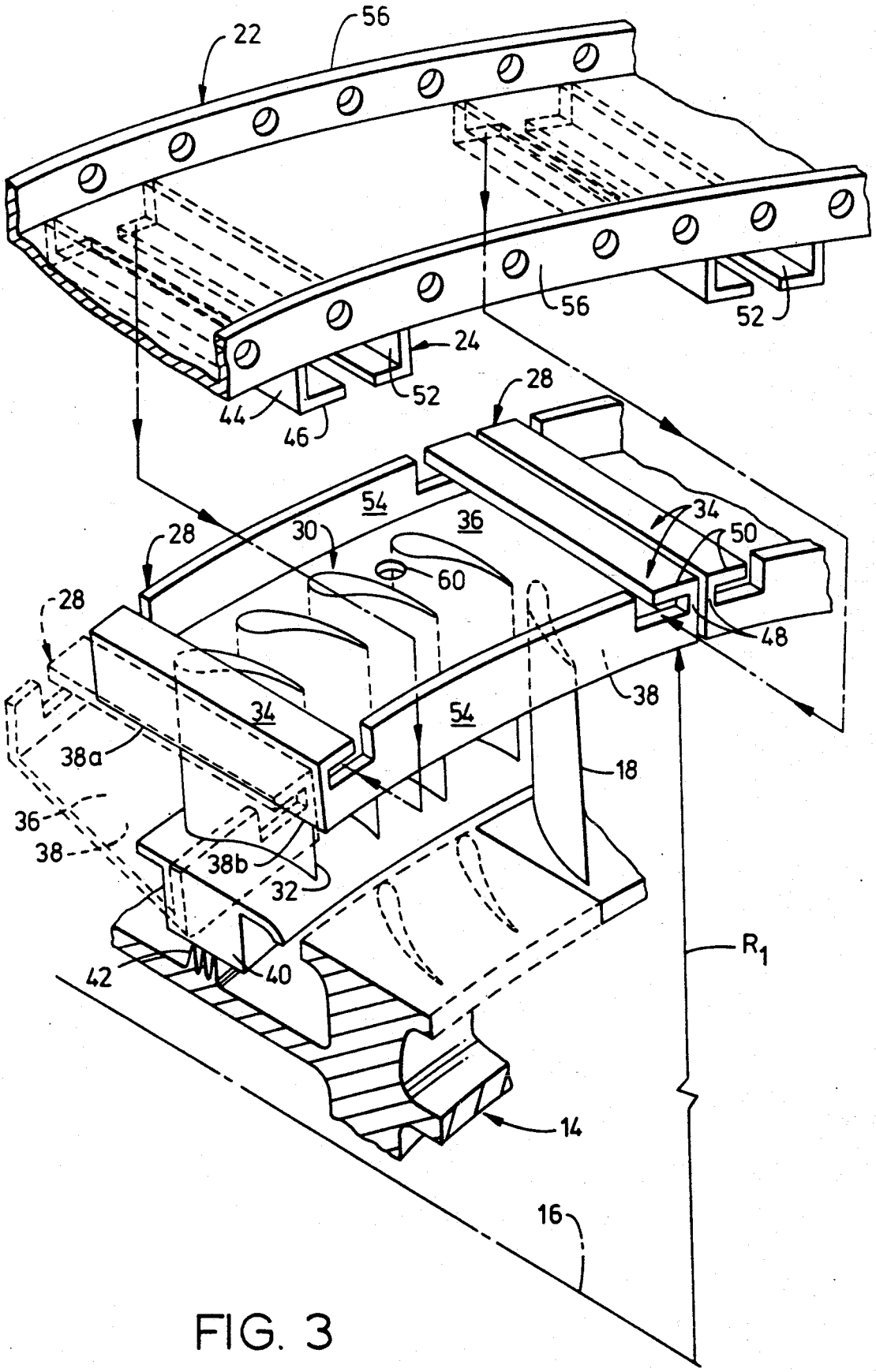
FIG. 3 is an exploded, perspective view of a portion of an exemplary compressor stator having a unitary outer case and a circumferentially segmented inner case.
Figure 4:
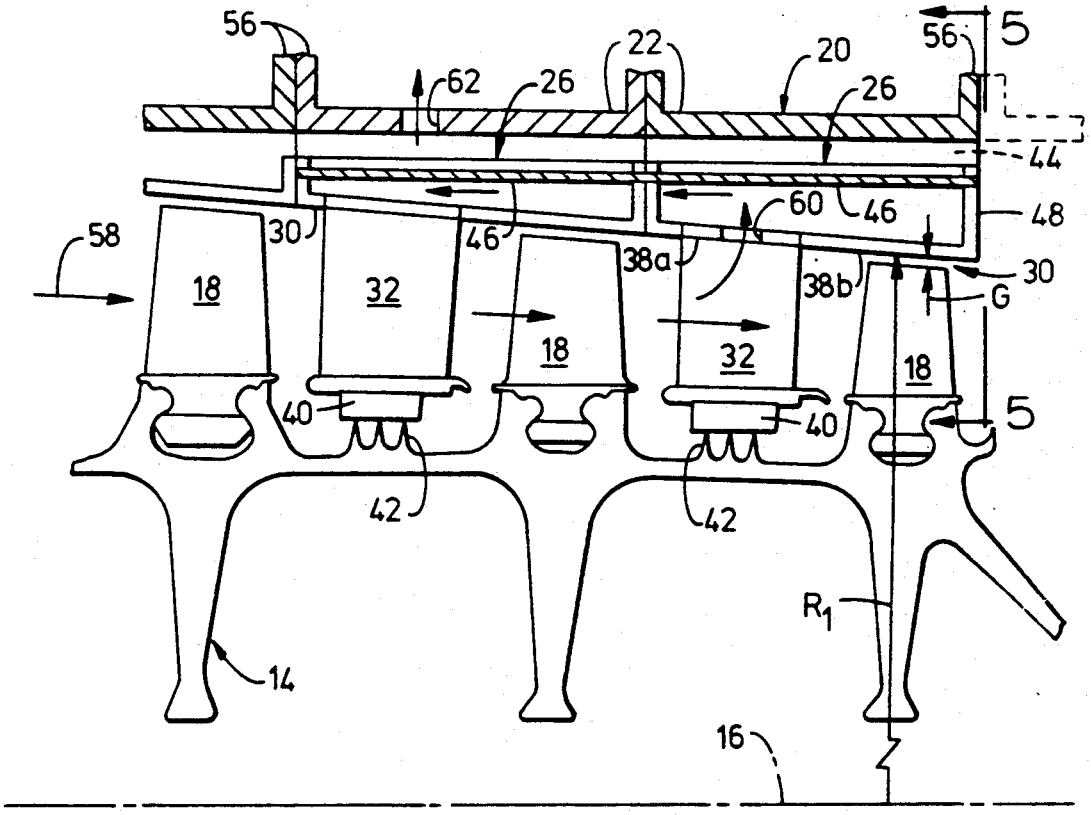
FIG. 4 is a longitudinal centerline schematic representation of the embodiment of the invention illustrated in FIG. 3 illustrating two axially abutting ones thereof.
Figure 5:
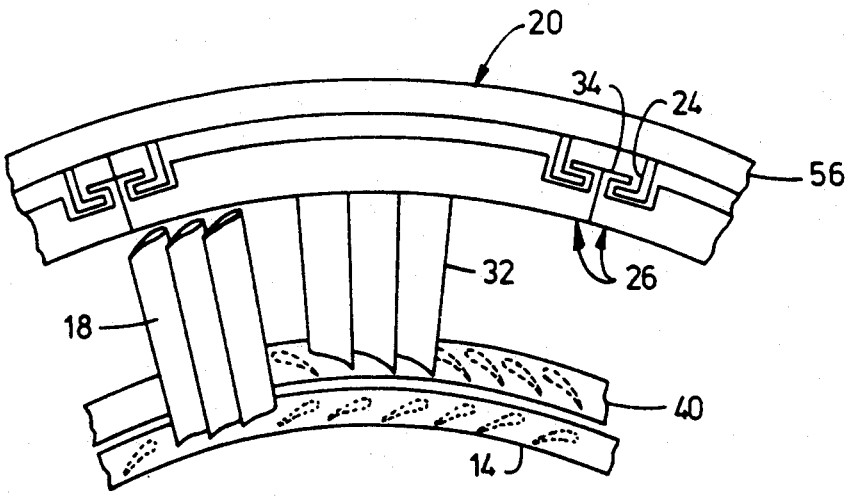
FIG. 5 is a transverse sectional view of a portion of one of the compressor stators illustrated in FIG. 4 taken along line 5—5.

FIGS. 1 and 2 disclosed above represent schematically the compressor stator 20 in accordance with the present invention. Disclosed hereinbelow with reference to the remaining drawing figures are several embodiments of the present invention which may be practiced in the compressor stator 20 illustrated in FIGS. 1 and 2. More specifically, illustrated in FIGS. 3–5 is one exemplary embodiment of the present invention. FIG. 3 illustrates an exploded view the outer case 22 removed from the inner case segment 28. Each of the shrouds 30 is disposed coaxially about the centerline axis 16 and includes an arcuate outer surface 36 and an opposite arcuate inner surface 38. As illustrated, each of the inner case segments 28 also includes at least one, and preferably two of the inner hooks 34 disposed on circumferentially opposite ends of the shroud 30. Each of the inner hooks 34 extends radially outwardly from the shroud outer surface 36 and axially parallel to the centerline axis 16. The outer and inner hooks 24 and 34 are complementary in shape, with respective ones thereof being axially slidably joined to each other for radially supporting the shroud inner surfaces 38, for example, axially transverse sections thereof, at a common radius $R_1$ from the centerline axis 16.

The vanes 32 extend radially inwardly from the shroud inner surface 38 and are fixedly joined to an arcuate inner band 40 which is positioned radially over conventional labyrinth seal teeth 42 extending from the rotor 14. The vanes 32 are conventionally joined to the shroud 30 and the band 40 by either brazing, welding, or being cast thereto in conventional fashion.

Each of the outer hooks 24 is preferably L-shaped having a radially inwardly extending leg 44 and a circumferentially extending foot 46 in transverse section. Each of the inner hooks 34 is also L-shaped in transverse section having a radially outwardly extending leg 48 and a circumferentially extending foot 50 which is axially slidably positioned radially over a respective outer hook foot 46.

In the exemplary embodiment illustrated in FIG. 3, adjacent ones of the outer hooks 24 are positioned with the feet 46 thereof facing each other to define an axially extending, rectangular channel 52. Adjacent ones of the inner hooks 34 on adjacent ones of the inner case segments 28 are positioned with the feet 50 thereof facing away from each other with the legs 48 being disposed adjacent to and abutting each other. In this way, a respective pair of the outer hooks 24 may be axially positioned under a respective pair of inner hooks 34 of adjacent inner case segments 28 for both radially supporting the inner case segments 28 and providing circumferential restraint thereof.

Also in the exemplary embodiment illustrated in FIG. 3, each of the shrouds 30 includes on opposite forward and aft axial ends thereof radial flanges 54 extending circumferentially between respective ones of the inner hooks 34 and radially outwardly from the shroud outer surface 36. These radial flanges 54 provide additional bending resistance to the inner case segment 28 for more accurately maintaining the arcuate profile of the shroud inner surface 38 at the radius $R_1$.

One advantage of the present invention allows for relatively easy assembly of the unitary outer case 22 with the plurality of inner case segments 28. More specifically, to assemble the compressor stator 20 simply requires that the inner case segments 28 be positioned circumferentially around the rotor 14 and in final position adjacent to a respective row of the blades 18 such as the first row illustrated in FIG. 1 under the forward outer casing 22*a*. The segments 28 may be temporarily conventionally circumferentially tied together by a suitable metal fixturing band for example.

The casing 22, casing 22*a* for example, is then translated axially parallel to the centerline axis 16 over the rotor 14 until the outer hooks 24 are positioned adjacent to the aft end of the inner hooks 34 as shown by the movement of the outer casing 22*a* in FIG. 1 from the right toward the left and as indicated schematically in FIG. 3 by following the phantom movement arrows axially. The feet 46 of the outer hooks 24 are then inserted radially under the feet 50 of the inner hooks 34 and the outer case 22 is then further translated axially parallel to the centerline axis 16 in the right-to-left direction with the legs 44 of the outer hooks 24 circumferentially clearing the feet 50 of the inner hooks 34. The fixturing band may be suitably removed once the outer and inner hooks 24, 34 are at least initially joined.

This assembly may all be accomplished in line-of-sight of the outer hooks 24 and the inner hooks 34 to ensure that all these hooks are fully joined together. As shown in dashed line in FIG. 1 for the outer casing 22*a* and in solid line in FIG. 4, a forwardmost one of the outer casings 22 is brought to its final position in abutting contact with respective ones of conventional radial flanges 56 used for joining together the components of the outer casing 22. As shown in FIG. 4, an individual outer case 22 and inner case 26 may be used for respective pairs of the vanes 32 and the blades 18, with two substantially identical and abutting outer cases 22, including respective inner cases 26, being used and being assembled in turn.

FIG. 5 shows a transverse upstream view of a portion of the aftmost one of the outer cases 20 and respective inner case 26 showing the final assembly thereof. As illustrated, the exemplary arrangement of the outer hooks 24 and the inner hooks 34 provides accurate radial positioning of the shroud inner surface 38 at the common radius $R_1$ while providing radial restraint. The hook arrangement joins the inner case segment 28 to the outer case 20 so that the segments 28 move radially in unison with the outer case 20. Since the inner case segments 28 are circumferentially split, each may expand and contract independently relative to the adjacent ones of the segments 28 with a suitable amount of circumferential clearance being provided between adjacent ones of the segments 28 and between the respective feet and legs of the outer and inner hooks 24 and 34. The hooks 24 and 34, therefore, restrain circumferential movement of the segments 28, while allowing a predetermined amount of differential thermal expansion and contraction therebetween. Each of the inner case segments 28 is axially restrained relative to its respective outer case 22 by abutting adjacent structures in the compressor stator 20, such as for example the axially adjacent inner case 26 as illustrated in FIG. 4.

Referring again to FIGS. 3 and 4, this exemplary embodiment of the compressor stator 20 includes the shroud 30 having a shroud inner surface first, or forward, portion 38*a* disposed radially over the vanes 32, and a shroud inner surface second, or aft, portion 38*b* disposed radially over the rotor blades 18 and axially downstream from the vanes 32. The shroud aft portion 38*b* then forms a radial gap G with the tips of the blades 18 through which a portion of air 58 being compressed by the compressor 10 necessarily leaks. Accordingly, it is desirable to maintain the radial gap G as small as practical and as uniform in the circumferential direction as possible. The compressor stator 20 having the axially extending outer hooks 24 and inner hooks 34 supports the inner case segments 28 from a fully annular and continuous outer case 22 which minimizes the circumferential distortions of the outer case 22, and therefore the inner case 26, as compared to a conventional horizontally split outer casing supporting stator vanes. Furthermore, since circumferential distortion of the outer case 22 and the inner case 26 is thereby reduced, or eliminated, the vanes 32 including the inner bands 40 are also more accurately radially positioned, which, thusly, reduces leakage past the labyrinth seal teeth 42.

Another advantage in utilizing the axially extending outer and inner hooks 24 and 34 is that fluid flow may be allowed in the axial direction and is not blocked by circumferentially extending hooks which might otherwise be used as disclosed in the prior art. Referring again to FIG. 4, the aft one of the inner cases 26 may include a bleed inlet 60 extending through the shroud 30 and between adjacent ones of the vanes 32 (also shown in FIG. 3), and the outer case 22 includes a bleed outlet 62 disposed radially over the forward one of the inner cases 26. The axially extending inner and outer hooks 24 of the two axially adjacent inner cases 26 allows fluid flow from the bleed inlet 60 to the bleed outlet 62 which, for example, may be used for increasing thermal expansion of the forward inner case 26 during a conventionally known reburst operation.

It is conventionally known that as the air 58 is compressed in turn in the succeeding stages of the compressor 10, it is being heated, with the air in each succeeding stage being at a higher temperature than the air in the preceding stage. By allowing the air 58 to be bled from a succeeding stage to a preceding stage as illustrated in FIG. 4, the air 58 bled through the inlet 60 is hotter than the air 58 being compressed in the compressor stage below the forward inner case 26, and thusly the inner case 26 and its outer case 22 may be heated to a higher temperature than would ordinarily occur for providing a quicker expansion thereof for reducing the likelihood of rubs between the tips of the blades 18 and the shroud 30 during the reburst operation where the rotor 14 including the blades 18 expands faster than the surrounding stator structure.

Figure 6:
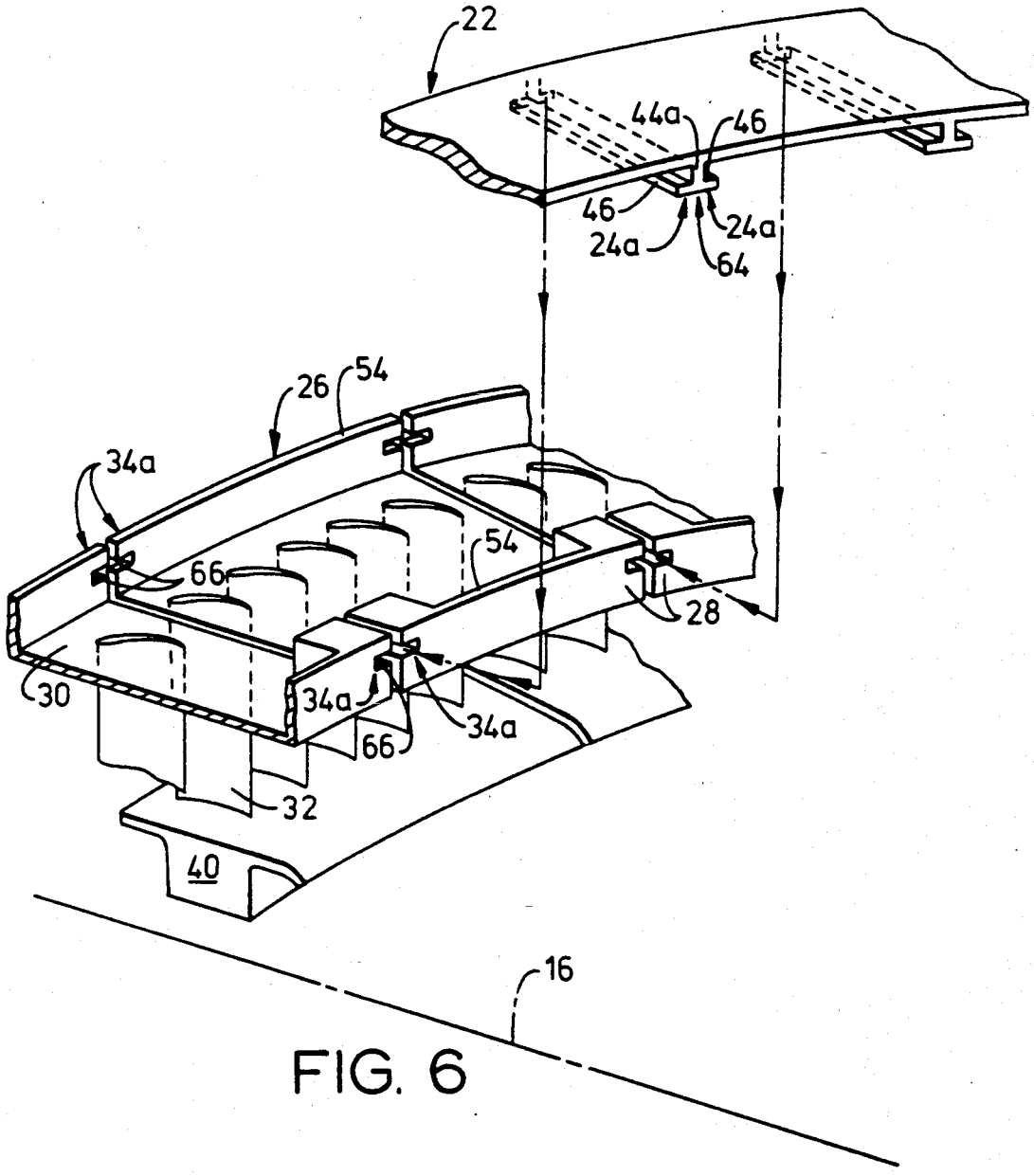
FIG. 6 is an exploded, perspective view of a compressor stator in accordance with another embodiment of the present invention.
Figure 7:
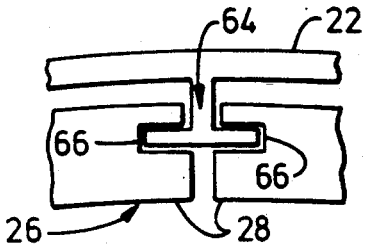
FIG. 7 is a transverse end view of a portion of adjacent ones of inner cases of the compressor stator illustrated in FIG. 6.

Illustrated in exploded view in FIG. 6 and in FIG. 7 is another embodiment of the present invention wherein adjacent ones of the outer hooks, designated 24*a*, have a common integral one of the legs, designated 44*a*, and the respective feet 50 thereof extend circumferentially oppositely to each other for defining a common T-shaped outer hook 64. Correspondingly, each of the inner hooks, designated 34*a*, is defined by an axially and circumferentially extending slot 66 disposed through the ends of the radial flanges 54. In the embodiment illustrated in FIGS. 6 and 7, the radial flanges 54 are disposed on opposite axial ends of the shroud 30 and are not otherwise connected to each other. The slots 66, therefore, are simply formed in the circumferential end of the radial flanges 54 and are radially aligned with each other parallel to the centerline axis 16.

As shown in FIG. 6, during assembly the outer case 22 is translated axially parallel to the centerline axis 16 (as in FIG. 1) for inserting one end of the T-hook 64 into the complementary slot 66 formed between adjacent ones of the segments 28. The segments 28 are suitably circumferentially positioned around the rotor 14, with the vanes 32 being finally positioned adjacent to respective ones of the blades 18, such as in any of the stages illustrated in FIG. 1, and may be suitably temporarily circumferentially joined together by the annular metal band as described above. The outer case 22 is then slid axially parallel to the centerline axis 16 and is fully inserted into the slot 66 through both axial ends of the segments 28 for radially supporting the segments 28. The temporary metal band is suitably removed, just as in the example presented above.

The T-hooks 64 radially support the segments 28 for radial movement thereof along with movement of the outer case 22. The T-hooks 64 also provide circumferential restraint of the segments 26 while allowing a predetermined amount of circumferential expansion and contraction between adjacent segments 28 by suitably circumferential clearance between the feet 50 and the slots 66. Just as in the above embodiment, the inner case segments 28 are axially restrained by adjacent structures, such as axially adjacent segments 28, for maintaining the axial position of the segments 28 relative to the outer case 22.

Figure 8:
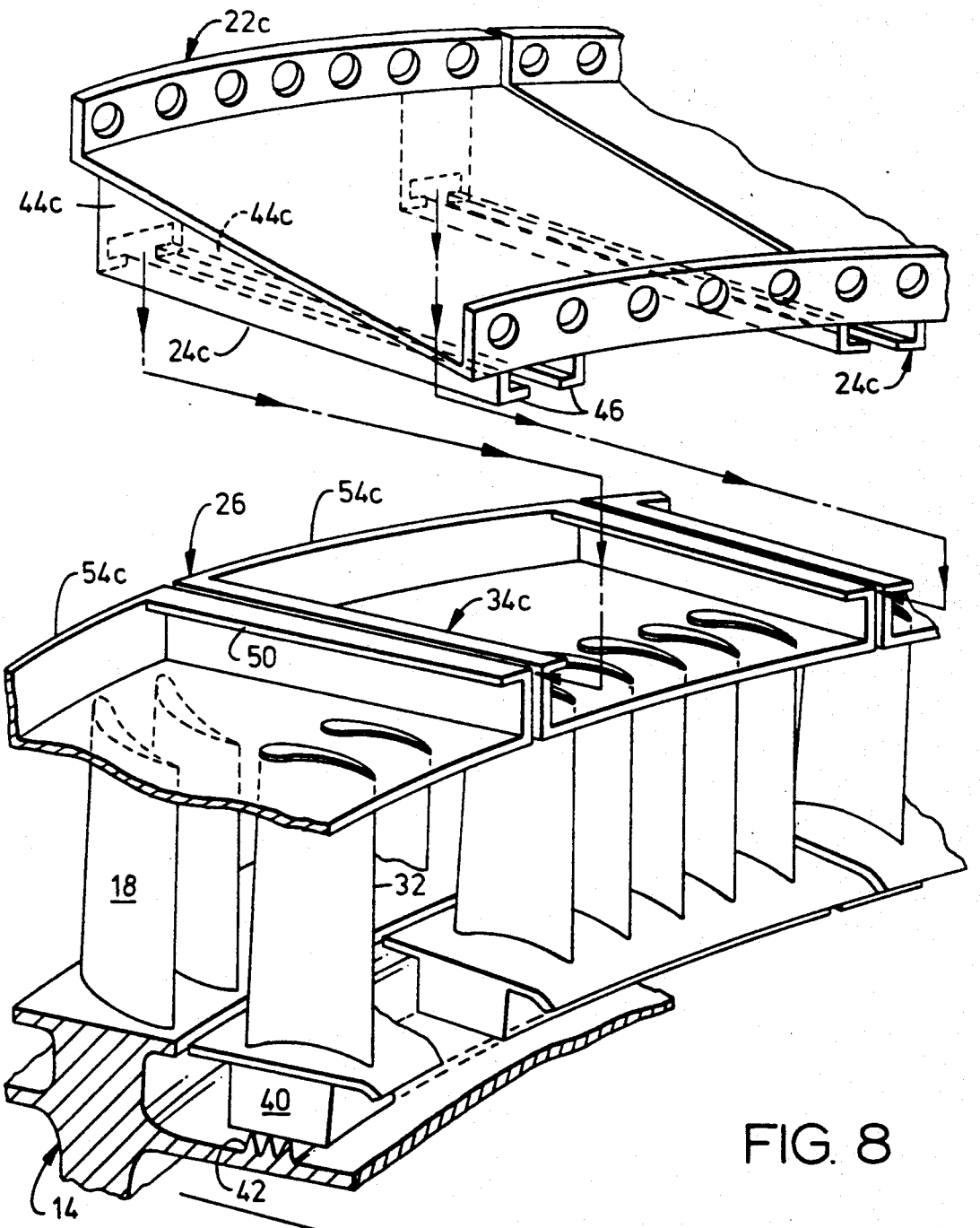
FIG. 8 is an exploded, perspective view of a compressor stator in accordance with another embodiment of the present invention.
Figure 9:
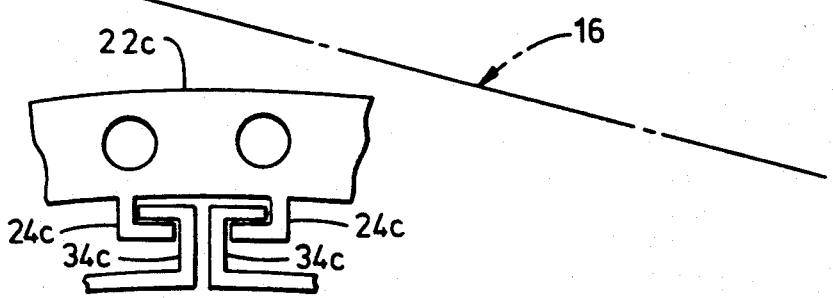
FIG. 9 is a transverse end view of a portion of adjacent inner cases of the compressor stator illustrated in FIG. 8.

In the embodiment of the invention disclosed above, the outer case 22 is cylindrical, with the outer hooks 24 being disposed parallel to the centerline axis 16 so that the outer case 22 may be simply assembled by being axially translated parallel to the centerline axis 16 over the inner case 26. Illustrated in FIGS. 8 and 9 is another embodiment of the present invention wherein the outer case 22, which is designated 22*c* is frusto-conical, with the outer hooks 24 arranged to extend axially parallel to the centerline axis 16 nevertheless. The outer hooks 24 are substantially identical in transverse section to the similar outer hooks 24 illustrated in the FIG. 3 embodiment of the invention, with the respective legs 44, designated 44*c*, being suitably tapered with a smaller radial dimension adjacent to the smaller diameter of the outer case 22 increasing to a larger radial dimension adjacent to the larger diameter of the outer case 22c so that the feet 46 remain parallel to the centerline axis 16. In this way, the outer case 22c may be similarly assembled over the inner case 26 by being axially translated relative thereto as in the FIG. 3 embodiment of the invention.

In this embodiment of the invention, the inner hooks 34, designated 34c for this embodiment, are identical to the inner hooks 34 illustrated in the FIG. 3 embodiment, except, however, the aft radial flange 54 of the FIG. 3 embodiment is not included, and the forward radial flange 54, designated 54c, extends completely and integrally with the forward end of the inner hook 34c, without providing a recess therein for the leg 44c and the feet 46 as in the FIG. 3 embodiment. In this way, the outer hooks 24c may be axially translated under the feet 50 of the inner hooks 34c until they abut the forward radial flange 54c which prevents their further axial movement. FIG. 9 shows that the inner hooks 34c are radially and circumferentially supported to the outer hooks 24c in an identical fashion to the corresponding hooks as illustrated in the FIG. 5 embodiment.

An additional feature of the embodiment of the invention illustrated in FIG. 8 is that the stator vanes 32 may be disposed at the aft end thereof, with a row of the rotor blades 18 being positionable under a forward end thereof which is opposite to the orientation illustrated in the FIG. 3 embodiment.

Figure 10:
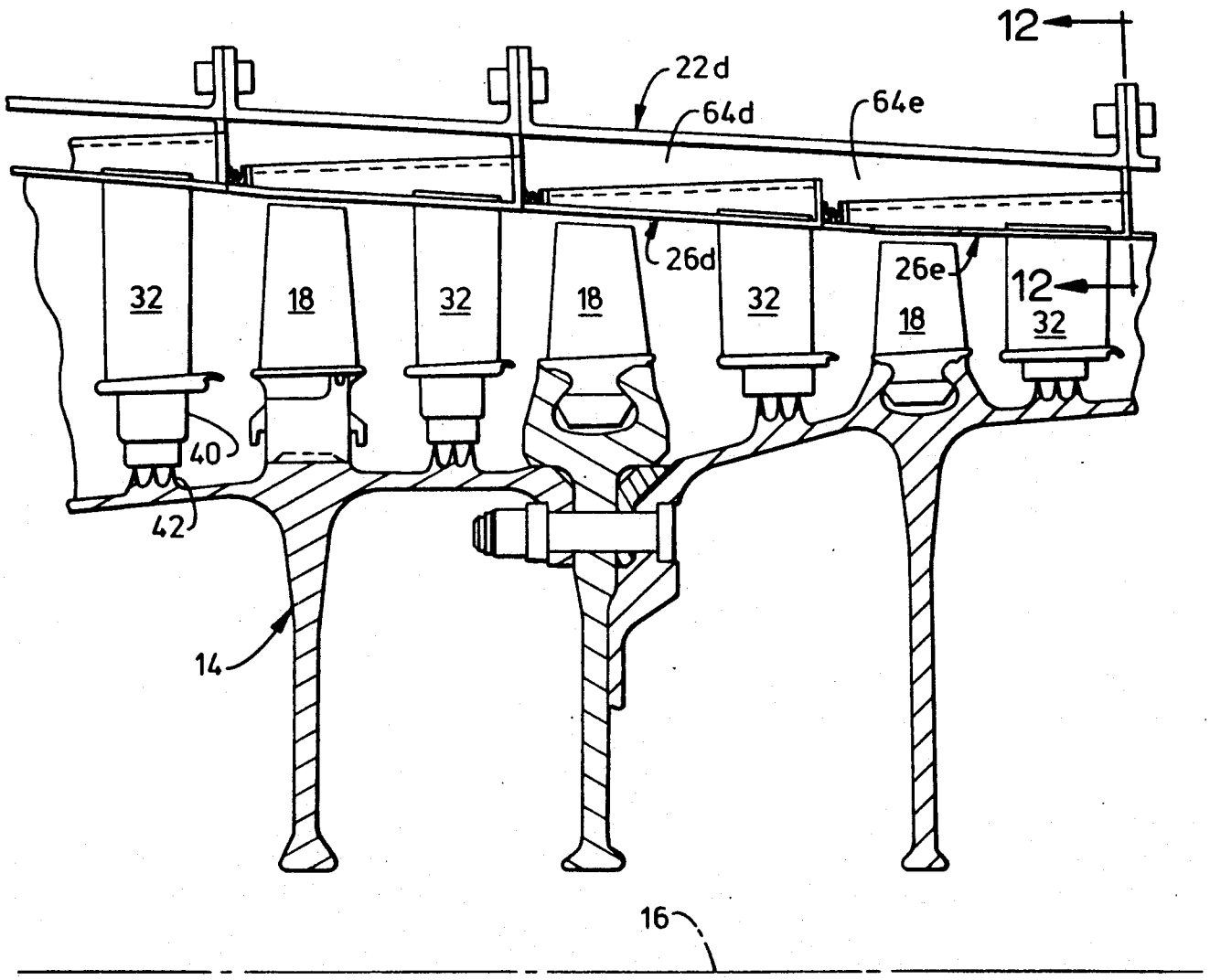
FIG. 10 is a longitudinal centerline schematic view of a compressor stator in accordance with another embodiment of the present invention.
Figure 11:
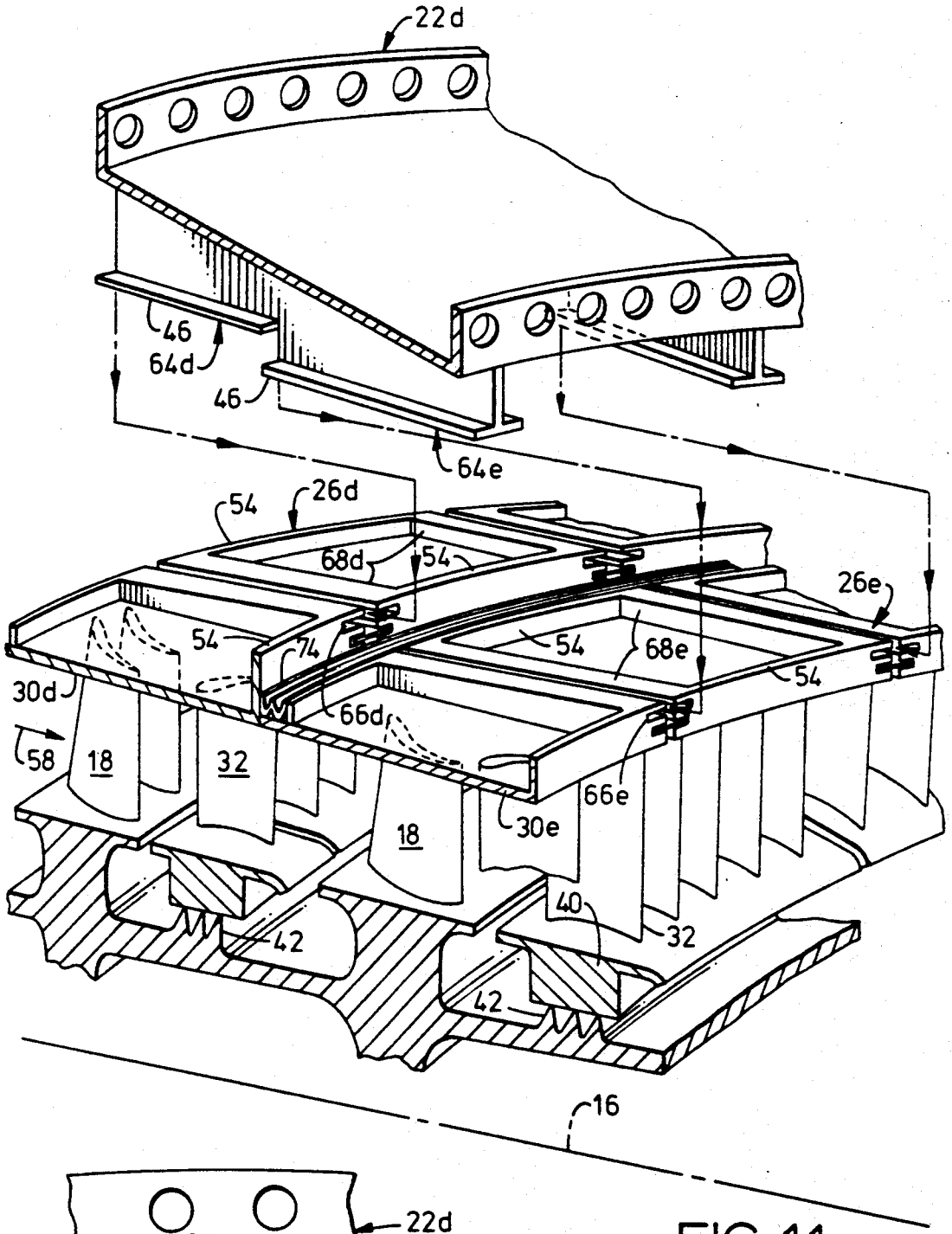
FIG. 11 is an exploded, perspective view of the compressor stator illustrated in FIG. 10.
Figure 12:
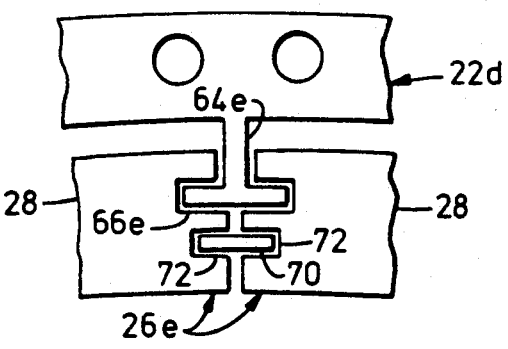

Illustrated in FIGS. 10, 11 and 12 is yet another embodiment of the present invention which uses features from the embodiments of the invention disclosed above. Whereas the embodiments of the invention disclosed above include the outer case 22 extending axially over only one of the inner cases 26, in this embodiment of the present invention the outer case, designated 22d, extends axially over at least two of the inner cases, i.e. a forward inner case 26d and an aft inner case 26e disposed axially adjacent to each other.

As shown in FIG. 11, respective shrouds 30d and 30e of the two inner cases 26d and 26e are preferably aligned coextensively with each other, which defines a common outer flow path for the compressed air 58. In this exemplary embodiment, the shrouds 30d and 30e are inclined radially inwardly in the downstream flow direction and in order to allow the outer case 22 to be axially translated during assembly, the outer case 22d preferably includes two axially aligned but radially offset ones of the T-hooks designated 64d and 64e which are substantially identical to the T-hook 64 illustrated in the FIG. 6 embodiment of the invention. The foot 46 of the forward T-hook 64d is disposed at a larger radius than that of the foot 46 of the aft T-hook 64e with both feet 46 still being aligned parallel to the centerline axis 16.

The respective aft radial flanges 54 of the forward inner case 26d and of the aft inner case 26e extend radially at different radii from the centerline axis 16, with the former being disposed at a larger radius than the latter. The respective forward and aft slots 66d and 66e which are substantially identical to the slots 66 of the FIG. 6 embodiment, may then each extend parallel to the centerline axis 16 for respective alignment with the outer T-hooks 64d and 64e upon assembly. In this embodiment of the present invention, each of the shrouds 30d and 30e includes on opposite circumferential ends thereof axial flanges 68d and 68e extending axially between respective ones of the radial flanges 54 and radially outwardly from the outer surfaces of the shrouds 30d and 30e. The respective slots 66d and 66e extend completely axially along the axial flanges 68d and 68e and between the radial flanges 54.

To assemble the embodiment of the invention illustrated in FIGS. 10 and 11, the inner cases 26d and 26e are again suitably positioned adjacent to their respective rotor blades 18, and temporarily circumferentially joined together by the suitable metallic bands, for example, and then the outer case 22d is axially translated parallel to the centerline axis 16 until the respective outer T-hooks 64d and 64e are aligned with their respective slots 66d and 66e. The outer case 22d is then axially translated in the forward direction thusly inserting the feet 46 of the outer hooks 64d and 64e fully into their respective slots 66d and 66e. The forward end of the aft outer hooks 64e preferably abuts the aft end of the aft flange 54 of the forward inner case 26d for axially restraining movement between the inner cases 26d, 26e and the outer case 22d.

As illustrated in FIG. 12, the inner cases 26d, 26e may include conventional spline seals 70 extending axially in respective slots 72 suitably formed between adjacent ones of the inner case segments 28. Similar spline seals 70 may be used in all of the embodiments of the invention disclosed above but have not been shown in the drawings for improving clarity of presentation.

Illustrated in FIG. 11, is a conventional annular W-seal 74 which may be provided axially between the radial flanges 54 of the adjacent inner cases 26d and 26e for providing suitable sealing.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

We claim:

1. A compressor stator having an axial centerline axis comprising:

a unitary annular outer case disposed coaxially with said centerline axis and having a plurality of circumferentially spaced outer hooks extending radially inwardly therefrom and axially parallel to said centerline axis;

a circumferentially segmented inner case disposed radially inwardly of said outer case and coaxially with said centerline axis, and having a plurality of circumferentially abutting, arcuate inner case segments, each of said inner case segments including an arcuate shroud having outer and inner surfaces, and at least one inner hook extending radially outwardly from said shroud outer surface and axially parallel to said centerline axis; and said outer and inner hooks being complementary in shape, with respective ones of said outer and inner hooks being axially slidably joined to each other for radially supporting said shroud inner surfaces at a common radius.

2. A compressor stator according to claim 1 wherein each of said inner case segments includes two of said inner hooks circumferentially spaced apart.

3. A compressor stator according to claim 2 wherein said inner case segment further includes a plurality of circumferentially spaced vanes extending radially inwardly from said shroud inner surface and fixedly joined to an arcuate inner band positionable over seal teeth.

4. A compressor stator according to claim 3 wherein said shroud inner surface includes a first portion disposed radially over said vanes, and a second portion disposable radially over a plurality of circumferentially spaced rotor blades positionable axially adjacent to said vanes.

5. A compressor stator according to claim 3 wherein said outer case extends axially over only one of said inner cases.

6. A compressor stator according to claim 3 wherein said outer case extends axially over at least two of said inner cases disposed axially adjacent to each other.

7. A compressor stator according to claim 6 wherein an aft one of said inner cases includes a bleed inlet through said shroud and between adjacent ones of said vanes, and said outer case includes a bleed outlet disposed over a forward one of said inner cases, said axially extending inner and outer hooks of said two inner cases allowing fluid flow from said bleed inlet to said bleed outlet for increasing thermal expansion of said inner case.

8. A compressor stator according to claim 3 wherein said outer case is cylindrical.

9. A compressor stator according to claim 3 wherein said outer case is frusto-conical and said outer hooks extend axially parallel to said centerline axis.

10. A compressor stator according to claim 3 wherein said outer hook is L-shaped having a radially inwardly extending leg and a circumferentially extending foot, and said inner hook is L-shaped having a radially outwardly extending leg and a circumferentially extending foot axially slidably positioned radially over said outer hook foot.

11. A compressor stator according to claim 10 wherein adjacent ones of said outer hooks are positioned with said feet thereof facing each other to define an axially extending channel, and adjacent ones of said inner hooks on adjacent ones of said inner segments are positioned with said feet thereof facing away from each other with said legs thereof disposed adjacent to each other.

12. A compressor stator according to claim 11 wherein each of said shrouds includes on opposite axial ends thereof radial flanges extending circumferentially between respective ones of said inner hooks and radially outwardly from said shroud outer surface.

13. A compressor stator according to claim 12 wherein adjacent ones of said outer hooks have a common integral one of said legs and said feet thereof extend circumferentially oppositely to each other for defining a common T-shaped outer hook.

14. A compressor stator according to claim 13 wherein each of said inner hooks is defined by an axially and circumferentially extending slot disposed in an end of said radial flange.

15. A compressor stator according to claim 14 wherein each of said shrouds includes on opposite circumferential ends thereof axial flanges extending axially between respective ones of said radial flanges and radially outwardly from said shroud outer surface, and said slot extends along said axial flanges between said radial flanges.

* * * * *